United States Patent [19]

Savoy et al.

[11] Patent Number: 4,898,104

[45] Date of Patent: Feb. 6, 1990

[54] ARMING AND HANDLING SHIELD FOR OILFIELD AND OTHER EXPLOSIVE DEVICES

[76] Inventors: Thomas D. Savoy, 216 Malibou Blvd.; Herbert J. Wallace, 121 Royce St., both of Houma, La. 71040

[21] Appl. No.: 259,142

[22] Filed: Oct. 18, 1988

[51] Int. Cl.[4] ..... E05G 3/00; E06B 9/00

[52] U.S. Cl. ..... 109/1 R; 109/24; 109/49.5; 109/84

[58] Field of Search ..... 109/1 R, 1 S, 24, 49.5, 109/82–84; 138/160, 161; 52/727, 728

[56] References Cited

U.S. PATENT DOCUMENTS

| | | | |
|---|---|---|---|
| 2,417,331 | 3/1947 | Taylor . | |
| 3,721,201 | 3/1973 | Boller | 109/49.5 |
| 3,820,479 | 6/1974 | Fylling | 109/1 R |
| 4,027,601 | 6/1977 | Hickerson | 109/49.5 |
| 4,292,882 | 10/1981 | Clausen | 109/82 |
| 4,453,353 | 6/1984 | Killop et al. | 52/728 |
| 4,531,639 | 7/1985 | Zopf . | |
| 4,632,041 | 12/1986 | Ohlson | 109/15 |
| 4,674,394 | 6/1987 | Martino | 109/49.5 |
| 4,723,800 | 2/1988 | Sanders . | |
| 4,732,803 | 3/1988 | Smith, Jr. | 109/49.5 |
| 4,733,773 | 3/1988 | LaBianca et al. . | |

*Primary Examiner*—Neill R. Wilson

*Attorney, Agent, or Firm*—Fleit, Jacobson, Cohn, Price, Holman & Stern

[57] ABSTRACT

A shield to be used while arming and handling oilfield and other explosive devices. The shield is constructed of anti-shrapnel materials and is of tubular construction to directionally concentrate and channelize explosive forces away from workers during the assembly, arming and handling of explosive devices of various types and especially wireline utilized in oilfields such as wireline guns, jet cutters, chemical cutters and perforating charges with the shield containing and diverting the directionally concentrated shaped charges away from personnel operating the device.

9 Claims, 2 Drawing Sheets

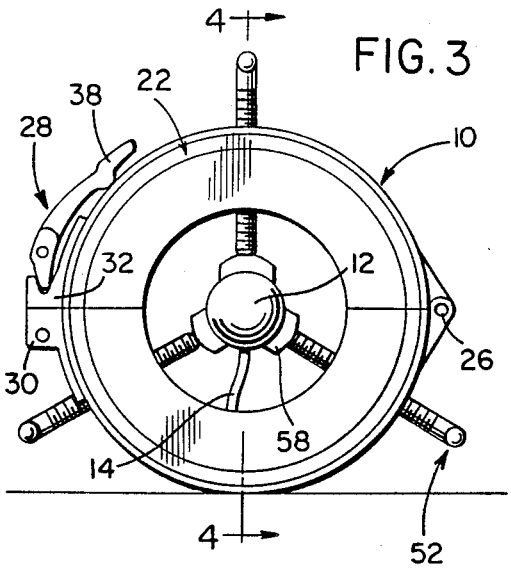
FIG. 3
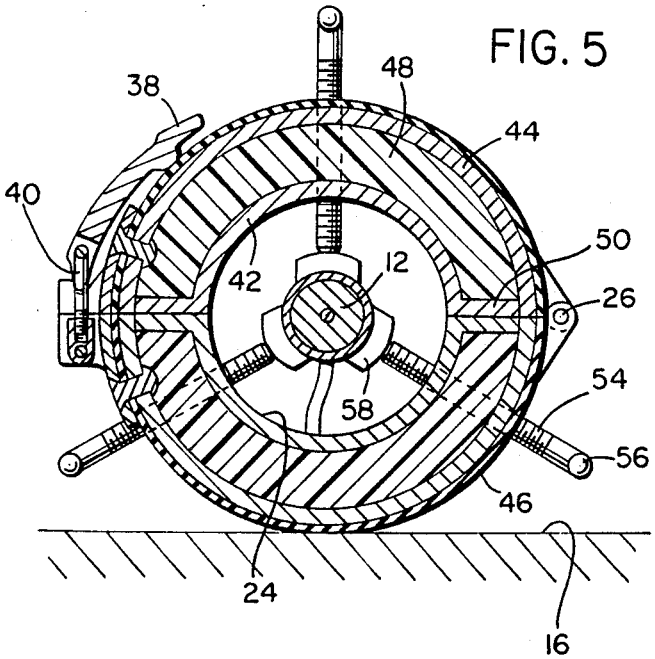
FIG. 5
FIG. 4
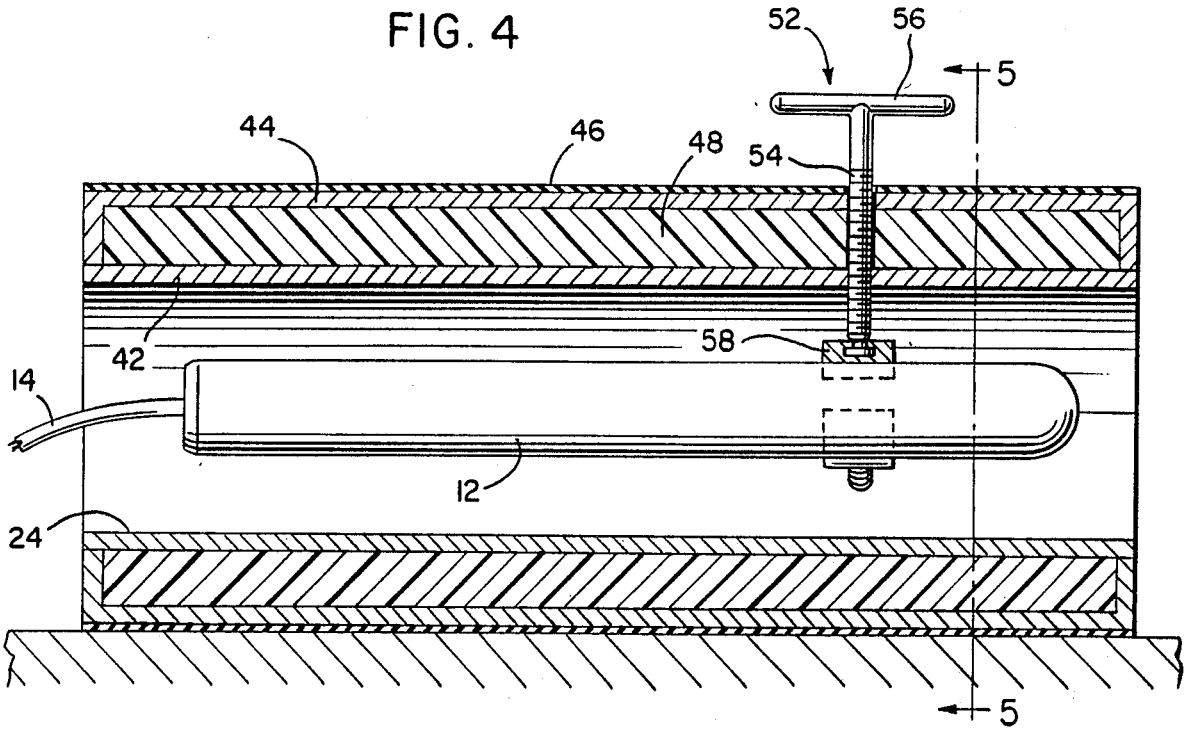

ARMING AND HANDLING SHIELD FOR OILFIELD AND OTHER EXPLOSIVE DEVICES

BACKGROUND OF THE INVENTION

1. FIELD OF THE INVENTION

The present invention generally relates to a safety shield and more specifically a shield to be used while arming and handling oilfield and other explosive devices. The shield is constructed of anti-shrapnel materials and is of tubular construction to directionally concentrate and channelize explosive forces away from workers during the assembly, arming and handling of explosive devices of various types and especially wireline explosive devices utilized in oilfields such as wireline guns, jet cutters, chemical cutters and perforating charges with the shield containing and diverting the directionally concentrated shaped charges away from personnel operating the device.

2. INFORMATION DISCLOSURE STATEMENT

Numerous devices are used in the oilfield to penetrate tubular metal pipes oriented in a vertical well bore. Such devices have high energy output and are usually explosive devices that are detonated with blasting caps or small explosive shells. An inherent hazard exists when handling, assembling, arming or running these devices into the work area due to the close association of blasting caps or explosive shells with the penetrating medium and instances of severe injury and fatal accidents have occurred since devices capable of penetrating metal tubular pipes or other tubular members are capable of producing shrapnel that can seriously injure and even fatally injure adjacent personnel. One example of this ongoing problem is in the production of oil in which the well bore includes a casing and tubing inside the casing. The tubing must be perforated at selected depths which is usually accomplished by the use of an explosive device detonated from the surface by an electrical charge which is transmitted through a device known as a "wireline". It is also necessary to rework a well at certain times which requires the cutting and retrieving of the tubing with the tubing usually being cut with an explosive device known as a "jet cutter" or "tubing cutter" which is also detonated through a wireline from the surface. There have been instances where the explosive devices have been detonated prematurely by stray voltage charges, radio charges and human error which can result in serious bodily injury or death to adjacent personnel.

The following U.S. patents are relevant to the invention but they do not disclose a structure equivalent to the invention.

2,417,331
3,721,201
4,027,601
4,531,639
4,723,800
4,733,773

SUMMARY OF THE INVENTION

An object of the present invention is to provide a shield for use when assembling, arming and handling an explosive device such as a wireline gun utilized in the oil industry but which is capable of use with other explosive devices which includes a tubular member having open ends and a peripheral wall resistant to the explosive force produced by an explosive device within the tubular member with the explosive force being directionally controlled for exit from the shield at each end thereof.

Another object of the invention is to provide a shield in accordance with the preceding object constructed in the form of a generally cylindrical shell including an inner shell or tube and an outer shell or tube spaced apart by concussion resistant material available from E.I. Dupont, Inc. under the trademark "Kevlar 29".

A further object of the invention is to provide a shield in accordance with the preceding objects having radially adjustable centralizer pods to insure centralization of the explosive device with respect to the shield to assure maximum energy loss prior to contact with the inner wall or inner tube.

Yet another object of the invention is to provide a shield in accordance with the preceding objects constructed of two hingedly connected semi-cylindrical members with latch structures connecting the hingedly connected members in enclosing relation to the explosive device which is easily assembled and disassembled with respect to the explosive device to facilitate use of the device on a wireline gun or other tool with the wireline and shield then being lowered to a point below the rotary table and safely away from personnel before the shield is removed.

A still further object of the invention is to provide a shield which will effectively protect personnel from various explosive devices as set forth in the preceding objects and which is relatively simple in construction, easy to assemble and disassemble with respect to explosive devices and highly effective in protecting personnel from premature detonation of the explosive devices.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is an end elevational view of the shield illustrating the positioning of an explosive device therein by the centralizing pods.

FIG. 4 is a longitudinal, sectional view taken substantially upon a plane passing along section line 4—4 on FIG. 3 illustrating further structural details of the invention.

FIG. 5 is a transverse, sectional view taken substantially upon a plane passing along section line 5—5 on FIG. 4 illustrating further structural details of the hinges, latches and adjustable supporting pods.

DESCRIPTION OF THE PREFERRED EMBODIMENT

Figure 1:
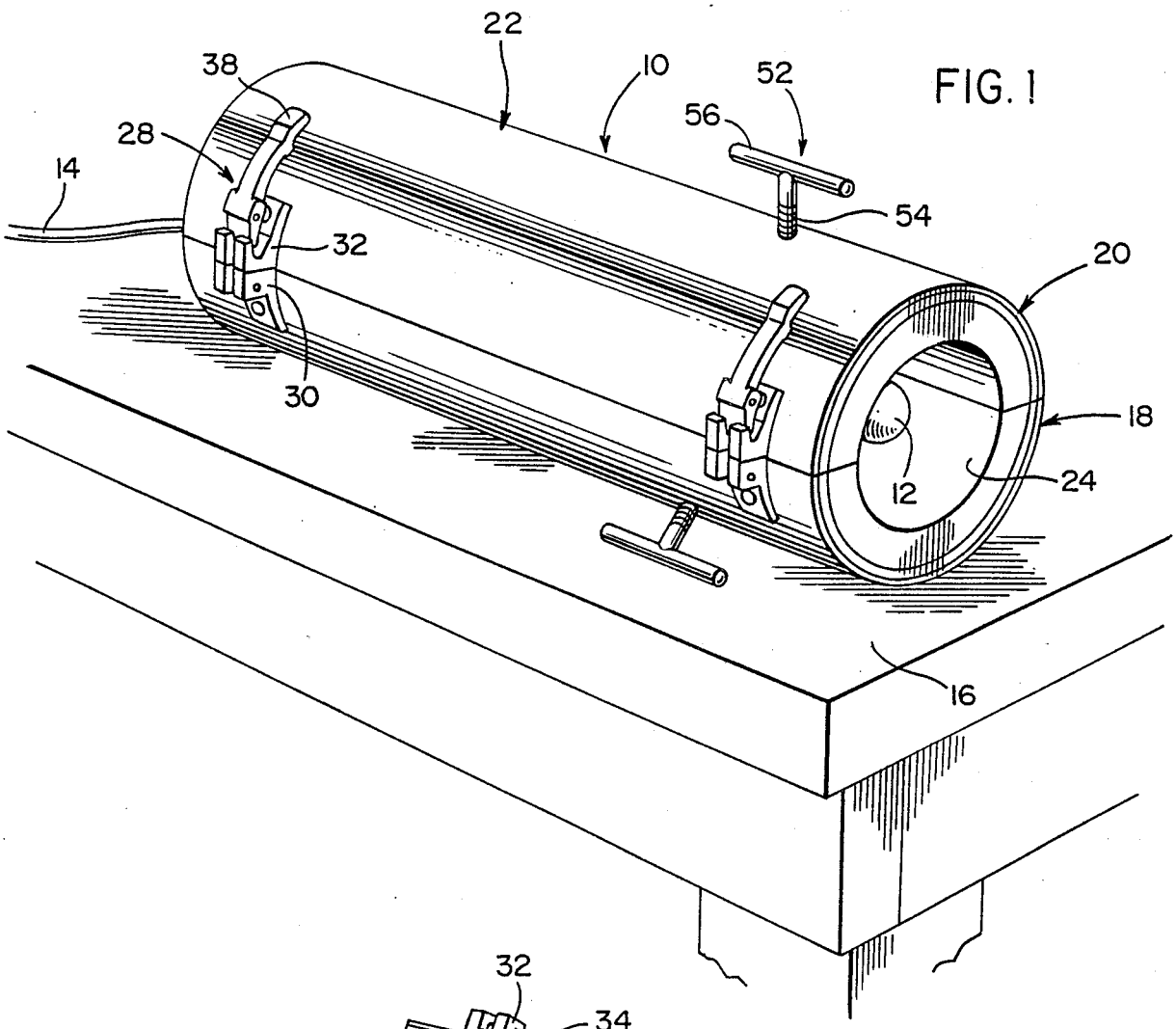
FIG. 1 is a perspective view of the arming and handling shield of the present invention.
Figure 2:
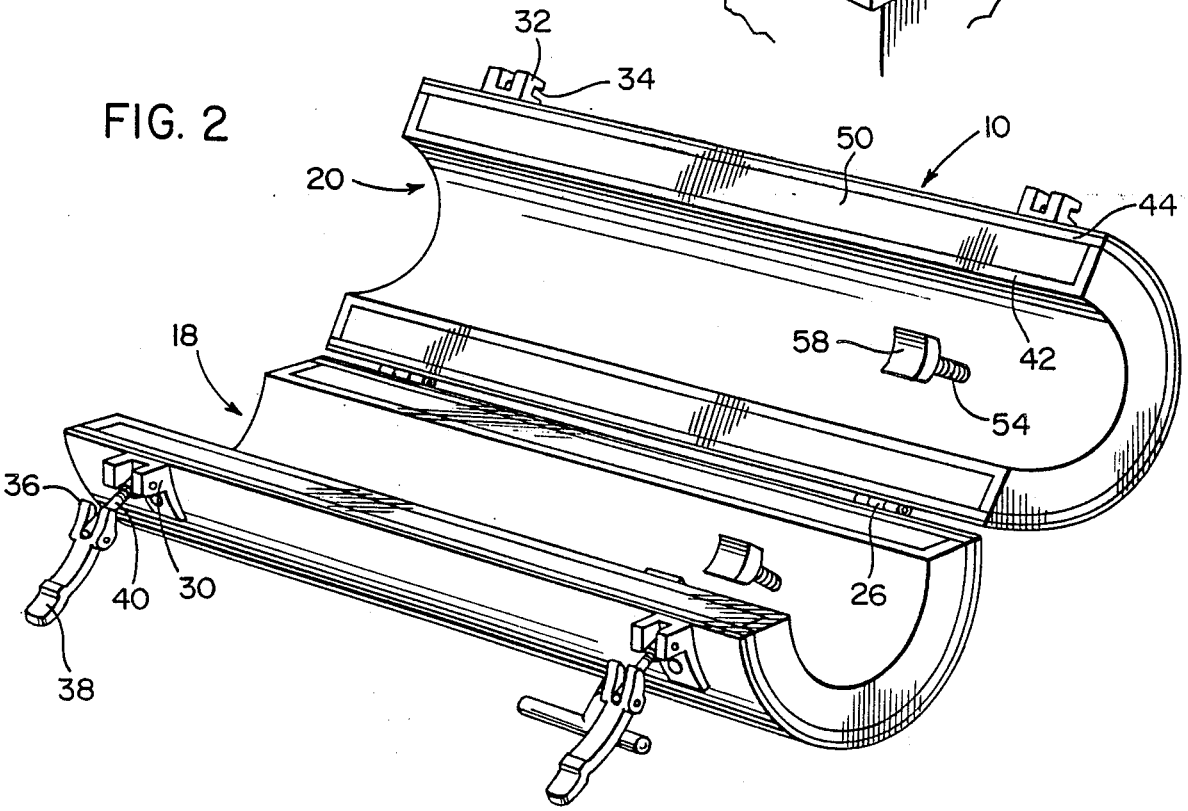
FIG. 2 is a perspective view of the shield in open position for receiving an explosive device.

The arming and handling shield of the present invention is generally designated by the numeral 10 and is adapted to receive various types of explosive devices including a wireline explosive device or gun generally designated by numeral 12. The details of the wireline device are not shown since it may vary depending upon the type of tool or gun to be used in a well bore. As illustrated, the explosive device is generally an elongated cylindrical member having a wireline 14 connected thereto for transmission of an electrical charge to the explosive device 12 to detonate it. As illustrated, the shield 10 may be positioned on a supporting surface 16 which may be any planar surface such as a stand or table or the floor of an oilwell rig or the like.

The shield 10 includes two elongated semi-cylindrical shells 18 and 20 which, when in closed, operative condition define an elongated hollow shell 22 as illustrated in FIG. 1 which includes a hollow tubular interior 24. The two half shells 18 and 20 are hingedly connected by hinge structures 26 along one edge thereof and are releasably retained in closed position by latch structures 28 at the opposite edges of the semi-cylindrical sections 18 and 20. The latch structures include a pivotal over-center latch 28 which includes lugs 30 on the section 18 and lugs 32 on the section 20 with the lugs 32 including recesses 34 to engage the ends 36 of a latch member 38 that is pivotally connected to the lugs 30 by a pivotal retaining member 40 with these components forming an over-center latch structure to retain the sections 18 and 20 in closed, operative position as illustrated in FIG. 1 in which the hollow interior 24 receives the explosive device 12.

As illustrated in FIGS. 4 and 5, the cylindrical shell 22 includes an inner shell 42 and an outer shell 44 provided with a plastic coating 46 on the exterior thereof. Intermediate the inner and outer shells 42 and 44 is a plurality of layers of concussion resistant material 48. As illustrated in FIG. 5, the shells 42 and 44 are divided into semi-cylindrical members to form the sections 18 and 30 with the edges of the half shells 42 and 44 being rigidly connected by walls 50 whereby the concussion resistant material 48 is completely enclosed between the inner and outer shells 42 and 44.

Positioned in spaced relation to one end of the cylindrical shell 22 is a plurality of centralizer pods 52 with there being three centralizer pods located closer to one end of the shell 22 than the other. Each of the centralizer pods includes an externally screw threaded rod 54 that is threaded through the inner and outer shells 42 and 44. The outer end of the rod 54 is provided with a T-handle 56 rigid therewith and the inner end of each threaded rod 54 is provided with a saddle 58 of arcuate configuration that is swivelly connected to the inner end of the rod 54 with the inner surface of the saddle 58 being concave to engage the exterior of the cylindrical explosive device 12 as illustrated in FIGS. 3 and 5.

The inner tube or shell 42 is preferrably constructed of aluminum that is approximately ½" thick that will receive the initial explosive charge. The concussion resistant material includes a plurality of layers of "Kevlar 29". Preferrably approximately 40 layers of "Kevlar 29" is used although the number of layers may vary depending upon the characteristics of the explosive device. This material is basically an aramid fiber material used in bulletproof vests and other similar protective garments and will dissipate the explosive energy of the explosive device. The outer shell 44 is also an aluminum tube which may be approximately ½" thick which will stop any remaining explosive energy and debris which may have penetrated the inner shell 42 and the "Kevlar 29" 48. The external coating 46 includes silver paint to prevent stay radio signals from prematurely detonating the charge. The coating 46 is of plastic or rubber material and is shown externally but also may be on the internal surface to insulate the explosive device from stray voltage that may exist in the metal deck of the oil rig. The centralizer pods 52 are constructed of "Teflon" and are spaced approximately 6" from one end of the shield to insure centralization of the explosive device 12 which provides maximum energy loss prior to the explosive force coming into contact with the inner shell 42 of the shield. The latch assemblies 28 and the hinges 26 enable removal of the shield from the explosive device or wireline gun after the explosive device is below the rotary table and safely away from personnel thus making the device effective to use.

As indicated, the shield will be sized for the specific dimensions and explosive characteristics of the particular tool with which it is to be used. Usually, the explosive devices, especially those used in the oilfield, are constructed to penetrate a specified diameter and thickness of tube which is usually of steel but the explosive device will stop short of penetrating the adjacent casing wall in the well. The American Petroleum Institute has published tables of penetrations by the use of various mediums and these tables are used in determining the size and projective characteristics of the protective apparatus or shield. The arming and handling shield will allow safe arming of explosive penetrating devices during assembly and attachment to wireline positioning gear and will allow the explosive device to be safely placed inside the metal tubulars to be cut or penetrated. Even if the explosive device is prematurely detonated while in the shield, the explosive force of the blast would be directed out the ends of the shield as would any debris or shrapnel thereby protecting adjacent personnel from serious injury.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An arming and handling shield for explosive devices comprising an elongated rigid shell having a hollow interior and end openings and means extending into the interior of the shell for supporting and positioning an explosive device within the hollow interior of the shell, said shell being constructed of material resistant to forces generated when the explosive device is detonated and directing the forces from the end openings in the shell to protect adjacent personnel from injury, said shell being substantially cylindrical in configuration and formed by a pair of elongated semi-cylindrical shell sections which are hingedly connected along one longitudinal edge thereof and provided with releasable latch means along the other longitudinal edge thereof to enable the semi-cylindrical shell sections to be pivoted between open and closed positions to facilitate assembly of the explosive device in the shell and removal of the shell from the explosive device after the explosive device has been assembled, armed and placed in a position where no further danger exists for adjacent personnel, said shell including concentrically arranged inner and outer walls of metal which are spaced apart to define an internal cavity between the inner and outer walls, a plurality of layers of concussion resistant material positioned between the inner and outer walls and filling the inner cavity to resist radial concussion forces and shrapnel and diverting such forces and shrapnel toward the end openings in the shell and away from adjacent personnel, said layers of concussion resistant material including multiple layers of aramid fiber cloth, said concussion resistant material includes approximately 40 layers of "Kevlar 29", the interior of said shell being cylindrical and the end openings being the same diameter as the interior of the shell, the inner wall of the shell being aluminum and approximately ½" thick and the outer wall also being aluminum with the inner wall at least partially confining the initial concussion force in the event the explosive device is detonated and the layered concussion resistant material further dissipating the concussion forces with the outer wall completely stopping any remaining forces and debris which may have penetrated the layered concussion resistant material.

2. A shield for protecting personnel when assembling and handling a wireline explosive device used in oilfields such as jet cutters, chemical cutters and perforating devices having a wireline attached thereto extending to a structure for detonating the explosive device comprising an elongated, rigid shell having a hollow interior and open ends, said shell being constructed of materials resistant to concussion forces and centralizing means supporting the explosive device centrally in the interior of the shell whereby explosive forces will be diverted to the open ends of the shell.

3. An arming and handling shield for explosive devices comprising an elongated rigid shell having a hollow interior and open ends and means extending into the interior of the shell for supporting and positioning an explosive device within the hollow interior of the shell, said shell being constructed of material resistant to forces generated when the explosive device is detonated and directing the forces from the open ends in the shell to preeotect adjacent personnel from injury, said shell including concentrically arranged inner and outer walls of metal which are spaced apart to define an internal cavity between the inner and outer walls, concussion resistant material positioned in the internal cavity between the inner and outer walls to resist radial concussion forces and shrapnel and diverting such forces and shrapnel toward the ends in the shell and away from adjacent personnel, said concussion resistant material including multiple layers of aramid fiber cloth, the open ends having the same cross sectional area as the interior of the shell, the walls of the shell being aluminum with the inner wall at least partially confining the initial concussion forces in the event the explosive device is detonated and the concussion resistant material further dissipating the concussion forces with the outer wall completely stopping any remaining forces and debris which may have penetrated the layered resistant material.

4. The structure as defined in claim 3 wherein said shell includes a longitudinal slit extending from end-to-end of the shell to enable the shell to be opened for laterally receiving an explosive device, and latch means bridging the slit on the exterior of the shell to retain the slit in the shell in closed position.

5. The structure as defined in claim 3 wherein said means supporting and positioning the explosive device includes a plurality of radially extending support members mounted on the shell in equal circumferentially spaced, aligned relation, each of said support members being screw threaded through the walls of the shell to enable radial adjustment thereof to position the explosive device in the central portion of the hollow interior of the shell.

6. The structure as defined in claim 10 wherein said shell includes a longitudinal slit extending from end-to-end of the shell to enable the shell to be opened for laterally receiving an explosive device, and latch means bridging the slit on the exterior of the shell to retain the slit in the shell in closed position.

7. The structure as defined in claim 6 wherein said inner and outer walls of the shell are cylindrical, each of said support members includes a saddle on the inner end thereof to engage the explosive device and a handle on the outer end thereof to adjust the support members, said concussion resistant material including layers of "Kevlar 29", the inner wall of said shell being aluminum and having a thickness of approximately ½" to receive and retain initial explosive forces.

8. A protective shield for explosive devices comprising a rigid shell having a hollow interior provided with end openings thereby enabling access to the interior of the shell, said shell being constructed of spaced concentric walls, projectile resistant material positioned between said walls of said shell, said shell including a lateral opening providing lateral access to the hollow interior to enable positioning of an explosive device into the hollow interior of the shell, means selectively retaining said lateral opening in closed position, and adjustable means extending radially through the walls of the shell into the hollow interior thereof with means on the inner end thereof for supporting an explosive device along the longitudinal center of the hollow interior of the shell.

9. The structure as defined in claim 8 wherein said walls are constructed of metallic material, said projectile resistant material including layers of aramid fiber material, the hollow interior of the shell having a substantially constant cross sectional area from end-to-end thereof.

* * * * *